US005088380A

United States Patent [19]

Minamitaka

[11] Patent Number: 5,088,380

[45] Date of Patent: Feb. 18, 1992

[54] MELODY ANALYZER FOR ANALYZING A MELODY WITH RESPECT TO INDIVIDUAL MELODY NOTES AND MELODY MOTION

[75] Inventor: Junichi Minamitaka, Fussa, Japan

[73] Assignee: Casio Computer Co., Ltd., Tokyo, Japan

[21] Appl. No.: 525,152

[22] Filed: May 17, 1990

[30] Foreign Application Priority Data

May 22, 1989 [JP] Japan ..... 1-126705

[51] Int. Cl.[5] ..... G10H 1/38; G10H 7/00

[52] U.S. Cl. ..... 84/637; 84/669; 84/DIG. 22

[58] Field of Search ..... 84/609, 610, 613, 634, 84/637, 650, 666, 669, 712, 715, DIG. 22

[56] References Cited

U.S. PATENT DOCUMENTS 4,539,882 9/1985 Yuzawa .
4,587,878 5/1986 Nakada et al. ..... 84/DIG. 22
4,633,751 1/1987 Fukaya et al. ..... 84/DIG. 22

FOREIGN PATENT DOCUMENTS 58-87593 5/1983 Japan .
62-187876 8/1987 Japan .
1-262595 10/1989 Japan .

*Primary Examiner*—Stanley J. Witkowski
*Attorney, Agent, or Firm*—Frishauf, Holtz, Goodman & Woodward

[57] ABSTRACT

A melody analyzer is provided which analyzes a given melody with respect to individual melody notes therein. In an embodiment, chord data in the form of a specific root and type, and tonality data in the form of a specific key note and mode are supplied to the melody analyzer. A chord note generator produces from the supplied chord a pitch class set of chord notes thereof while an available note generator develops from the supplied tonality and chord a pitch class set of available notes. A separator classifies each melody note into a harmonic tone and a nonharmonic tone in accordance with the chord note pitch class set. Another separator labels each melody note with either an available note or an unavailable note in accordance with the available note pitch class set. A motion evaluator evaluates motions in the supplied melody. An inference module having a stored network representative of note classifying knowledge further identifies each available labeled and each unavailable labeled melody note based on the evaluated melody motions from the motion evaluator and the classified results from the separators.

13 Claims, 13 Drawing Sheets

(VARIABLE LIST)

| | | |
|---|---|---|
| MELODY[I]) | : | I-TH MELODY NOTE |
| NOTE(MELODY[I]) | : | PITCH CLASS OF I-TH MELODY NOTE |
| OCTB(MELODY[I]) | : | OCTAVE NUMBER OF I-TH MELODY NOTE |
| LENM(MELODY[I]) | : | DURATION OF I-TH MELODY NOTE |
| CHORD[I] | : | I-TH CHORD IN SUCCESSION OF CHORDS |
| ROOT(CHORD[I]) | : | ROOT OF I-TH CHORD |
| TYPE(CHORD[I]) | : | TYPE OF I-TH CHORD |
| LENC(CHORD[I]) | : | DURATION OF I-TH CHORD |
| TOTALITY[I] | : | I-TH TOTALITY |
| KEY(TOTALITY[I]) | : | KEY NOTE OF I-TH TOTALITY |
| SCALE(TOTALITY[I]) | : | SCALE TYPE OF I-TH TOTALITY |
| LENT(TOTALITY[I]) | : | DURATION OF I-TH TOTALITY |
| CHORD(CHORD) | : | MUMBER NOTES OF CHORD |
| SCAKO(SCALE) | : | SCALE NOTES OF SCALE TYPE OF TOTALITY |
| DIATS(KEY) | : | SCALE NOTES ON KEY NOTE OF TOTALITY |
| TENSN(TYPE) | : | TENSION NOTES FOR CHORD TYPE |
| AVANS(CHORD,TOTALITY) | : | AVAILABLE NOTES |

FIG. 4A (EXAMPLE)

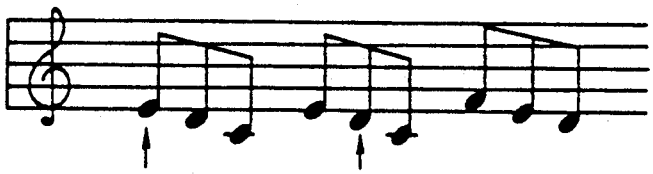

MELODY[0] MELODY[4]

NOTE(MELODY[4])="D"
OCTB(MELODY[4])="FOURTH OCTAVE"
LENM(MELODY[4])=" ♪ "

CHORD[0] CHORD[1]

ROOT(CHORD[0])="C"
TYPE(CHORD[0])="MAJOR"
LENC(CHORD[0])=" 𝅗𝅥. "=" ♪ × 6"

TONALITY[0]

KEY(TONALITY[0])="C"
SCALE(TONALITY[0])="MAJOR"
LENT(TONALITY[0])="2 BARS"
=" ♪ × 24"

CHOKO(C MAJ)="C,E,G"
SCAKO(MAJ)="DO,RE,MI,FA,SOL,LA,TI"
DIATS(MAJ ON C)="C,D,E,F,G,A,B"
TENSN(MAJ)="9TH,#11TH,13TH,M7TH"
AVANS(C MAJ,C MAJ)="D,A,B"

FIG. 4B

NOTE( ),ROOT( ),KEY( )

| PITCH CLASS | C | C# | D | E♭ | E | F | F# | G | A♭ | A | B♭ | B |
|---|---|---|---|---|---|---|---|---|---|---|---|---|
| DATA REPRESENTATION | 0 | 1 | 2 | 3 | 4 | 5 | 6 | 7 | 8 | 9 | 10 | 11 |

TYPE( )

| CHORD TYPE | MAJ | MIN | 7TH | MAJ7 | MIN7 |
|---|---|---|---|---|---|
| DATA REPRESENTATION | 0 | 1 | 2 | 3 | 4 |

SCALE( )

| SCALE TYPE | NATURAL | MELODIC MIN | HARMONIC MIN |
|---|---|---|---|
| DATA REPRESENTAITON | 0 | 1 | 2 |

FIG. 5

{CHOCK( )}

| TYPE \ PC | C | C# | D | E♭ | E | F | F# | G | A♭ | A | B♭ | B |
|---|---|---|---|---|---|---|---|---|---|---|---|---|
| MAJ | ○ | | | | ○ | | | ○ | | | | |
| MIN | ○ | | | ○ | | | | ○ | | | | |
| 7TH | ○ | | | | ○ | | | ○ | | | ○ | |
| MAJ7 | ○ | | | | ○ | | | ○ | | | | ○ |
| MIN7 | ○ | | | ○ | | | | ○ | | | ○ | |

* CHORD NOTES ON ROOT OF C

FIG. 6

{TENSN( )}

| TYPE \ PC | C | C# | D | E♭ | E | F | F# | G | A♭ | A | B♭ | B |
|---|---|---|---|---|---|---|---|---|---|---|---|---|
| MAJ | | | ○ | | | | ○ | | | ○ | | ○ |
| MIN | | | ○ | | | ○ | | | | | ○ | |
| 7TH | | ○ | ○ | ○ | | | | | ○ | ○ | | |
| MAJ7 | | | ○ | | | | ○ | | | ○ | | |
| MIN7 | | | ○ | | | ○ | | | | | | |

* TENSION NOTES ON ROOT OF C

FIG. 7

{SCAKO( )}

| TYPE | C | C# | D | E♭ | E | F | F# | G | A♭ | A | B♭ | B |
|---|---|---|---|---|---|---|---|---|---|---|---|---|
| NATURAL | ○ | | ○ | | ○ | ○ | | ○ | | ○ | | ○ |
| M.MIN | ○ | | ○ | | ○ | | ○ | | ○ | ○ | | ○ |
| H.MIN | ○ | | ○ | | ○ | ○ | | | ○ | ○ | | ○ |

*FOR NATURAL : SCALE NOTES ON KEY NOTE OF C
FOR M.MIN AND H.MIN :SCALE NOTES ON KEY NOTE OF A

| ADDRESS | DATA | COMMENTS | |
|---|---|---|---|
| 00 | 10H | CHORD NOTE TABLE BASE ADDRESS | |
| 01 | 20H | TENSION NOTE TABLE BASE ADDRESS | |
| 02 | 30H | SCALE NOTE TABLE BASE ADDRESS | |
| 10 | 91H | MAJ | CHORD NOTE |
| 11 | 89H | MIN | TABLE{CHOKO( )} |
| 12 | 491H | 7TH | |
| 13 | 891H | MAJ7 | |
| 14 | 489H | MIN7 | |
| 20 | A44H | MAJ | TENSION NOTE |
| 21 | 424H | MIN | TABLE{TENSN( )} |
| 22 | 30EH | 7TH | |
| 23 | 244H | MAJ7 | |
| 24 | 24H | MIN7 | |
| 30 | AB5H | NATURAL | SCALE NOTE |
| 31 | B55H | MELODIC MIN | TABLE{SCAKO( )} |
| 32 | B35H | HARMONIC MIN | |

FIG. 9

MELODY ANALYZER FOR ANALYZING A MELODY WITH RESPECT TO INDIVIDUAL MELODY NOTES AND MELODY MOTION

BACKGROUND OF THE INVENTION

The present invention relates in general to music systems and in particular to a melody analyzer which automatically analyzes a given melody with respect to musical functions or characters of individual notes contained in the melody.

Melody analyzers of this kind are disclosed in U.S. patent applications Ser. No. 07/177,592, filed Apr. 4, 1988, and Ser. No. 07/288,001, filed Dec. 20, 1988, both assigned to the same assignee as the present application, and incorporated herein as reference. Each analyzer of these patent applications is arranged to receive chord data as well as melody data to be analyzed. A harmonic/nonharmonic tone separator is provided which compares respective notes in the melody with members of the chord (chord notes) to separate (classify) the melody notes into two groups, i.e., a harmonic (chordal) melody note and a nonharmonic melody note. The system further comprises a melody motion evaluator that evaluates motions in the melody such as pitch intervals between successive melody notes and a subclassifying device that receives from the harmonic/nonharmonic tone separator melody notes labeled with a nonharmonic melody note to subclassify these melody notes based on classified harmonic/nonharmonic results of those melody notes around the respective nonharmonic labeled melody notes and based on evaluated motions associated with the respective nonharmonic labeled melody notes and their surrounding melody notes in order to further identify musical functions of the nonharmonic labeled melody notes.

The melody analyzer described above is based on the premise that any harmonic melody note (melody note that corresponds to one of the chord members) can freely be used in a melody, but a nonharmonic melody note (a note outside of the chord pitch contents) can only be used in restricted musical conditions of melody context. The above melody analyzer has no choice but to differentiate harmonic melody tones from nonharmonic melody tones unless additional reference information other than the chord is provided for comparison with the melody.

As experienced, there are a variety of melodies in music. Some melodies consist of only harmonic tones in which every melody note is a member of a coexisting chord in a succession of chords. Some melodies consist of harmonic tones freely used therein and restrictively used nonharmonic tones. In still some other melodies, one or more nonharmonic (out-of-chord) tones are freely used similarly to harmonic tones while other nonharmonic tones are limitedly used only as the melody context permits. In general, notes used in a melody depend on backgrounds of the melody such as musical style. In addition, notes available in a melody, to which a chord is applied, depend on what function that melody performs in the framework of the entire music piece so that they vary with the musical structures of the piece such as tonality structure. For this reason, only a portion of the melody notes can be derived from the chord.

In the presence of such diversity of melodies, the melody analyzer discussed above has an analysis limitation because of its assumption that only harmonic tones are freely used in a melody while nonharmonic tones are avoided or only limitedly used.

SUMMARY OF THE INVENTION

It is therefore an object of the present invention to provide an improved melody analyzer which takes a different approach from that of the prior art melody analyzer such as discussed above.

Another object of the invention is to provide a melody analyzer capable of analyzing melodies in more detail.

A further object of the invention is to provide a melody analyzer capable of handling various melodies in view of diversified musical styles and backgrounds.

In accordance with one aspect of the invention, there is provided a melody analyzer which comprises available note generator means for generating from a given chord and a given tonality a set of available note pitches (pitch contents of a set of available notes), melody motion evaluator means for evaluating motions in a given melody and melody note classifying means for classifying each note in the melody based on the set of available note pitches and the evaluated motions in the melody.

This arrangement provides a new and improved analysis of a given melody with respect to musical functions of individual notes in the melody because instead of a set of chord note pitches (pitch contents of a given chord) in the prior art, a set of available note pitches (which may include pitches other than and in addition to the chord note pitches) are produced as a composite function of both the chord and the tonality. The set of available not pitches is then used to classify or identify respective notes in the melody.

Data of chord, tonality and melody may be input from a user by means of any suitable input unit. In the alternative, an automatic composer may produce such data using its automatic functions.

Typically, data of a given chord indicates or defines a root (root pitch) and type of the chord, e.g., F major. Data of a tonality typically indicates a key note and scale type (mode) of the tonality, e.g., C major. A user may supply the melody analyzer with a scale type either in the form of a subjective parameter such as brightness/darkness, or in the form of pitch intervallic relationships among the scale notes.

Data of a melody typically has a form which defines a succession of notes forming the melody.

In an embodiment, the available note generator means comprises a table memory for storing sets of available note pitches, each set being assigned to and addressed by a different one of all possible combinations of chords and tonalities, and access means for having access to the table memory by using a particular combination of a given chord and a given tonality to read a corresponding set of available note pitches. This arrangement, however, requires a relatively large storage capacity. To save the storage locations a preferred embodiment of the available note generator means may comprise chord note generator means for generating from a given chord (in the form of root and type) a set of chord note pitches of the chord, tension note generator means for generating from the given chord a pitch set of tension notes, each serving to create a sense of tension when simultaneously sounded with the associated chord, scale note generator means for generating from a given tonality a set of scale note pitches forming a scale of the tonality, common note generator means for generating a set of note pitches common to the set of the tension note pitches and the set of the scale note pitches, and means for combining the set of the common note pitches with the set of chord note pitches to provide a set of available note pitches.

The melody motion evaluator may be implemented in several ways. A simplified embodiment of the melody motion evaluator means may comprise a pitch interval evaluator that evaluates pitch intervals formed between any two adjacent notes in the melody. Another embodiment of the melody motion evaluator may be arranged to evaluate motions between any two successive notes in the melody to distinguish between the stepwise or conjunct motion and the leap or disjunct motion, and/or to evaluate motions or movements in three or more successive melody notes to distinguish for example between the passing movement and the neighboring movement.

The melody note classifying means may comprise available/unavailable classifying means for comparing the individual note pitches in the melody with the set of available note pitches to determine which melody notes belong to an available melody note and which melody notes belong to an unavailable note, and melody note subclassifying means for subclassifying and identifying in more detail those melody notes having been classified as (labeled with) an unavailable melody note with respect to their musical functions in the melody based on the evaluated motions in the melody from the melody motion evaluator means and the classified results from the available/unavailable classifying means.

In accordance with another aspect of the invention, there is provided a melody analyzer which comprises chord note generator means for generating from a given chord a set of chord note pitches thereof, available note generator means for generating from the chord and a given tonality a set of available note pitches exclusive of the chord note pitches, melody motion evaluator means for evaluating motions in a given melody and melody note classifying means for classifying each note in the melody based on the set of chord note pitches, the set of available note pitches and the evaluated motions in the melody.

With this arrangement, both the set of chord note pitches and the set of available note pitches are distinguishably passed to the melody note classifying means so that the note classifying means can accurately indentify musical functions of the respective melody notes whereby different analysis results will be obtained from melodies for analysis depending on their musical styles.

For example, with the set of chord note pitches and the set of available note pitches, the melody note classifying means may compare the individual melody note pitches with the set of chord note pitches and with the set of available note pitches to determine which melody notes belong to a harmonic (chordal) melody note and which melody notes belong to an available melody note to thereby classify the melody notes into three categories i.e., harmonic-labeled melody note, available-labeled melody note and unavailable-labeled (and non-harmonic at the same time) melody note. Based on the classified results and the evaluated motions in the melody, the melody note classifying means may subclassify the available-labeled melody notes and the unavailable labeled melody notes in more detail.

The term "available notes" refers in a narrow sense to those notes (exclusive of chord notes) which are freely used in a musical style such as jazz in a similar manner to chordal (harmonic) melody notes but in another musical style such as western classical music in the common practice period are desired to be limitedly used only when certain melody contextual conditions such as pitch motions are met. In a broarder sense "available notes" include chord notes as well. In both of the above two musical styles, a note which is neither chord note nor available note is desired to be used only in restricted musical conditions.

The term "pitch" does not necessarily mean "absolute pitch" of a note e.g., C in the fourth octave. It may refer to a "pitch class" or pitch name according to which pitches of, for example, C in the forth octave and C in the third octave are said to have the same pitch class of C.

In a preferred embodiment, the available note generator means comprise tension note generator means for generating from a given chord a set of tension note pitches therefor, scale note generator means for generating from a given tonality a set of scale note pitches therefor, and common note generator means for generating a set of available note pitches defined by those pitches common to the set of tension note pitches and the set of scale note pitches. This arrangement requires a smaller amount of internally stored data than an arrangement that directly generates a set of available note pitches from a combination of the chord and the tonality. It is readily possible to provide a plurality of available note generator means which generate different sets of available note pitches from one another. This can be accomplished by providing a plurality of different scale note generator means and/or a plurality of different tension note generator means. By handling different outputs from the plurality of different available note generator means (or an output from a variably selected one of the available note generators), the melody analyzer can provide melody analysis from various aspects.

To further reduce the required storage capacity of the available note generator means, the tension note generator means may preferably comprise tension note table storage means for storing, with respect to each type of chords having a predetermined root, a set of tension note pitches (or pitch intervals from the predetermined root), reading means responsive to a given chord for reading from the tension note table storage means a set of tension note pitches for a type of the given chord, and shifting means for shifting the set of the tension note pitches from the reading means in accordance with a root of the given chord in view of its pitch interval from the predetermined root in order to provide a set of tension note pitches for the given chord. Also the scale note generator means may similarly comprise scale note table storage means, reading means and shifting means. This arrangement of the tension note generator means requires only one N-th times the storage capacity of a chord/tension-note look-up table memory that stores a set of tension note pitches with respect to each combination of a type and a root of chords in which the total number of all possible root pitches is N, e.g., 12.

For a relatively long melody which may be considered a sequence of melodies (melody segments) each assigned to a different one of a plurality of musical time intervals, there may be correspondingly provided a sequence of (a plurality of) chords and a sequence of (a plurality of) tonalities. Typically, a single chord can last a period of time of at least one melody note whereas a single tonality normally lasts a period of time of at least one chord. The melody analyzer of the present invention can analyze such a sequence of melodies in substantially the same manner as described by difining a time (coexisting) relationship among the sequences of melodies, chords and tonalities.

In accordance with another aspect of the invention, there may be provided a melody analyzer which directly receives from an input unit a set of chord note pitches instead of a chord defined by its root and type, and/or directly receives from an input unit a set of available note pitches in place of a chord and a tonality. With such an arrangement, there is no need for the provision of the chord note generator means and/or available note generator means of the type described above.

BRIEF DESCRIPTION OF THE DRAWINGS

The above and other objects, features and advantages of the invention will be better understood from the following description taken in conjunction with the accompanying drawings in which:

FIGS. 4A and 4B show a list of musical variables used in the melody analyzer together with a specific example thereof;

FIG. 5 illustrates numerical data representation of musical variables;

FIG. 6 illustrates a chord member table;

FIG. 7 illustrates a tension note table;

FIG. 9 illustrates a memory map of the ROM in FIG. 1 including tables of FIGS. 5 to 8;

DETAILED DESCRIPTION OF PREFERRED EMBODIMENTS

Overall Arrangement

Figure 1:
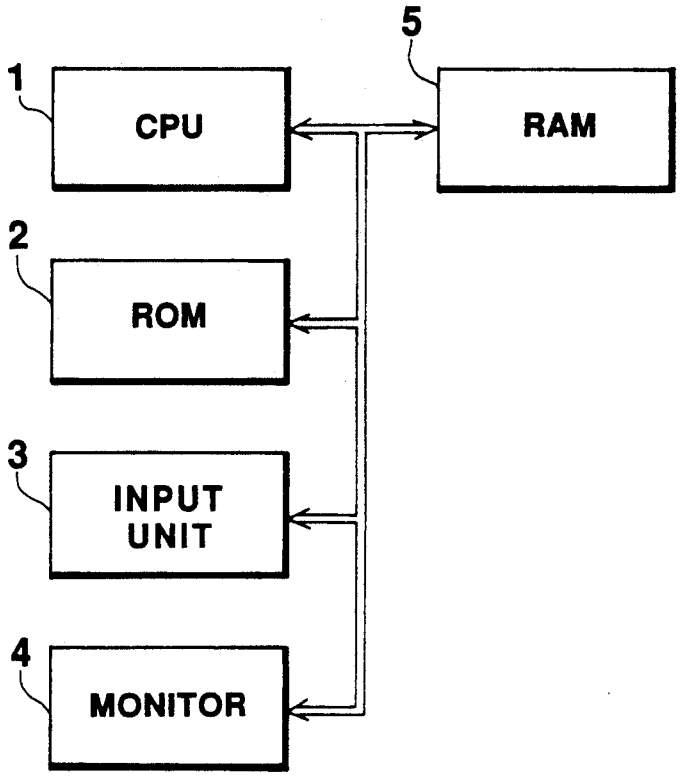
FIG. 1 is a block diagram of an overall arrangement of a melody analyzer in accordance with an embodiment of the invention.

Referring first to FIG. 1, there is shown a block diagram of an overall hardware arrangement of a melody analyzer in accordance with an embodiment of the invention. CPU1 controls the entire system by executing a program stored in ROM 2 to perform required functions including melody analysis. In addition to the program, ROM 2 also stores a plurality of tables such as chord note (member) table, tension note table and scale note table each to be referenced by CPU1 during the execution of the melody analysis program. An input unit 3 is used to enter data such as a melody. The input unit 3 may comprise a musical keyboard for inputting melody data on a real-time basis. A monitor 4 comprises CRT unit, printer and tone generator connected to an audio system to display, print and play a melody and/or analyzed results thereof. RAM5 is used as a working memory of CPU1 during the execution of the program.

Functions of Melody Analyzer

Figure 2:
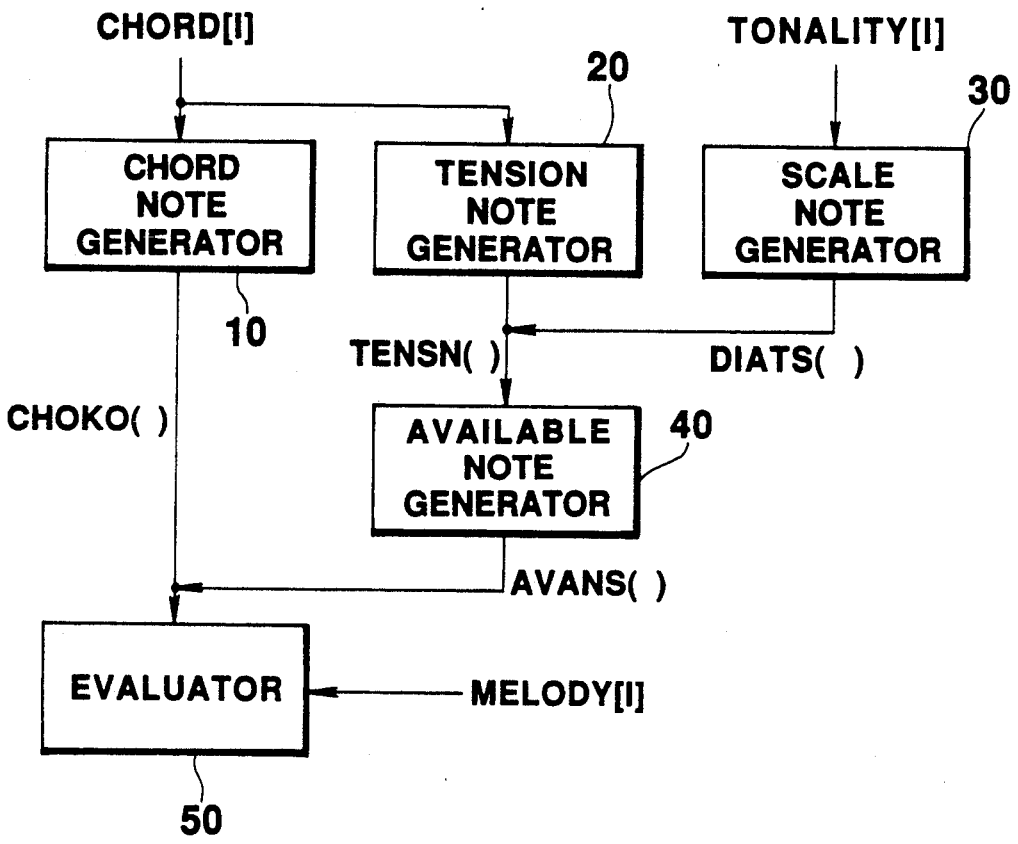
FIG. 2 is a block diagram showing functions of the melody analyzer.

FIG. 2 depicts a logical arrangement of the melody analyzer. The purpose of the melody analyzer is to classify or identify individual notes in a given melody from a given chord and a given tonality. In FIG. 2, an array {MELODY[]} indicates a melody i.e., a succession of melody notes. A second array {CHORD[]} denotes a succession of chords. A third array {TONALITY []} represents a sequence of tonalities. These arrays reside in RAM5 in FIG. 1 during the melody analysis operation of the system. A user may input data of melody, chord succession and tonality succession by means of the input unit 3. In the alternative, part or all of the data may automatically be generated. For example, automatic generation of a sequence of chords is accomplished based on a Markov process model of transition from one chord to another as disclosed in Japanese patent application laid open to public as Kokai Hei1-262595 and assigned to the same assignee as the present application, or by connecting relatively short patterns of functional chords in accordance with a hierarchic structure in music as disclosed in U.S. patent application Ser. No. 07/411,541, filed Sept. 22, 1989 and assigned to the same assignee as the present application. A succession of tonalities may be automatically derived from a succession of chords by evaluating tonal distances among the chords as proposed in U.S. patent application Ser. No. 07/288,001, filed Dec. 20, 1988 and assigned to the same assignee. Automatic composing of a melody is possible based on the Morkov process model of pitch transition between melody notes, as disclosed in Japanese patent application laid open to public as Kokai Sho62-187876 and assigned to the same assignee. It is also possible to automatically produce a chord succession from a given melody as disclosed in Japanese patent application laid open to public as Kokai Sho58-87593, U.S. Pat. No. 4,539,882 and U.S. patent application Ser. No. 07/335,213, filed on Apr. 6, 1989. All of these disclosures are incorporated herein by reference.

As best shown in FIGS. 4A and 4B, a given melody is represented by a succession of melody notes each designated by MELODY[I]. Each melody note data MELODY[I] comprises an absolute pitch designated by the combination of NOTE (MELODY[I]) and OCTB (MELODY[I]), and a duration designated by LENM (MELODY[I]). NOTE (MELODY[I]) indicates the pitch class of a melody note while OCTB (MELODY[I]) indicates the octave number thereof. All possible pitch classes are twelve in number from C to B. A succession of chords is represented by a one dimensional array of chord data designated by CHORD[I]. Each chord data comprises a root (pitch class) designated by ROOT (CHORD[I]), a type designated by TYPE (CHORD[I]), from which pitch intervallic relationship among the chord member notes is determined, and a duration designated by LENC(CHORD[I]). A succession of tonalities is represented by a one dimensional array of tonality data designated by TONALITY[I]. Each tonality data comprises a key note designated by KEY (TONALITY[I]) and a scale type or mode designated by SCALE (TONALITY[I]), from which pitch intervallic relationship of the scale notes is determined, and a duration designated by LENT (TONALITY[I]).

The melody analyzer in FIG. 2 is arranged to focus on coexisting musical elements of melody, chord and tonality during its analysis operation. For example, when trying to analyze or identify the musical function of the fifth melody note MELODY[4], in the melody array {MELODY[]} (see FIG. 4B), the melody analyzer references a chord existing at that melody note time, here in FIG. 4B, the first chord CHORD[0] in the chord succession array {CHORD[]} and also references a coexisting tonality, here in FIG. 4B, the first tonality TONALITY[0] in the tonality succession array }TONALITY[]}.

Turning back to FIG. 2, the melody analyzer comprises a chord note generator 10 which generates from data CHORD[I] of a given chord specifying a root and type thereof a set of chord note pitch classes thereof, i.e., pitch contents of the given chord. For example, given a chord of C major, the chord note generator 10 produces chord notes of C, E and G. The generated chord note (pitch) data is denoted in FIG. 2 by CHOKO ( ).

A tension note generator 20 serves to generate from the given chord data CHORD[I], a pitch class set of tension notes therefor, designated by TENSN( ).

A scale note generator 30 is adapted to generate from data TONALITY[I] of a given tonality a pitch class set (pitch contents) of scale notes therefor, designated by DIATS( ).

To improve a storage efficiency, each of the chord note generator 10, tension note generator 20 and scale note generator 30 may preferably comprise a look-up (data transforming) table to be looked up from one of the input parameters, and a pitch shifter for shifting the table output in accordance with the other of the input parameters. For example, the chord note generator 10 comprises a chord note table for converting a type of a given chord to a pitch class set of chord notes on a predetermined chord root (or a set of chord notes in terms of their pitch interval from the chord root), and a pitch shifter for shifting the pitch class set of the chord notes from the table in accordance with a root of the given chord. Given a chord of D minor, for example, with D indicative of a root and minor indicative of a type, corresponding chord notes from the table are (first degree or C, minor third degree or EY, perfect fifth or G), which may be numerically represented by data of (0,3, 7). Shifting these chord notes in accordance with the given chord root of D numerically represented by 2 will result in chord notes of (D, F, G), numerically represented by (2, 5, 9) from (2+0, 2+3, 2+7). This arrangement reduces the required storage capacity to one twelveth times that of a complete chord note table memory that stores a set of chord notes with respect to each type and each root of chords because there are twelve different root pitch classes in total.

Similarly, the tension note generator may comprise a tension note table for converting the given chord type to a set of tension notes in terms of their relative pitches i.e., pitch intervals from a chord root, and a pitch shifter for shifting the set of tension notes from the table in accordance with the given chord root pitch class. Also, the scale generator may comprise a scale note table for converting a scale type of a given tonality to a set of scale notes in terms of their pitch intervals from a key note, and a pitch shifter for shifting the set of scale notes looked up from the table in accordance with a key note of the given tonality.

An evaluator 50 is arranged to receive a set of chord notes CHOKO( ) from the chord note generator 10, a set of available notes AVANS( ) from an available note generator 40 for evaluation of a given melody. The function of the evaluator 50 is to classify and identify each note MELODY[I] in a given melody based on chord notes CHOKO( ) and available notes AVANS( ).

Figure 3:
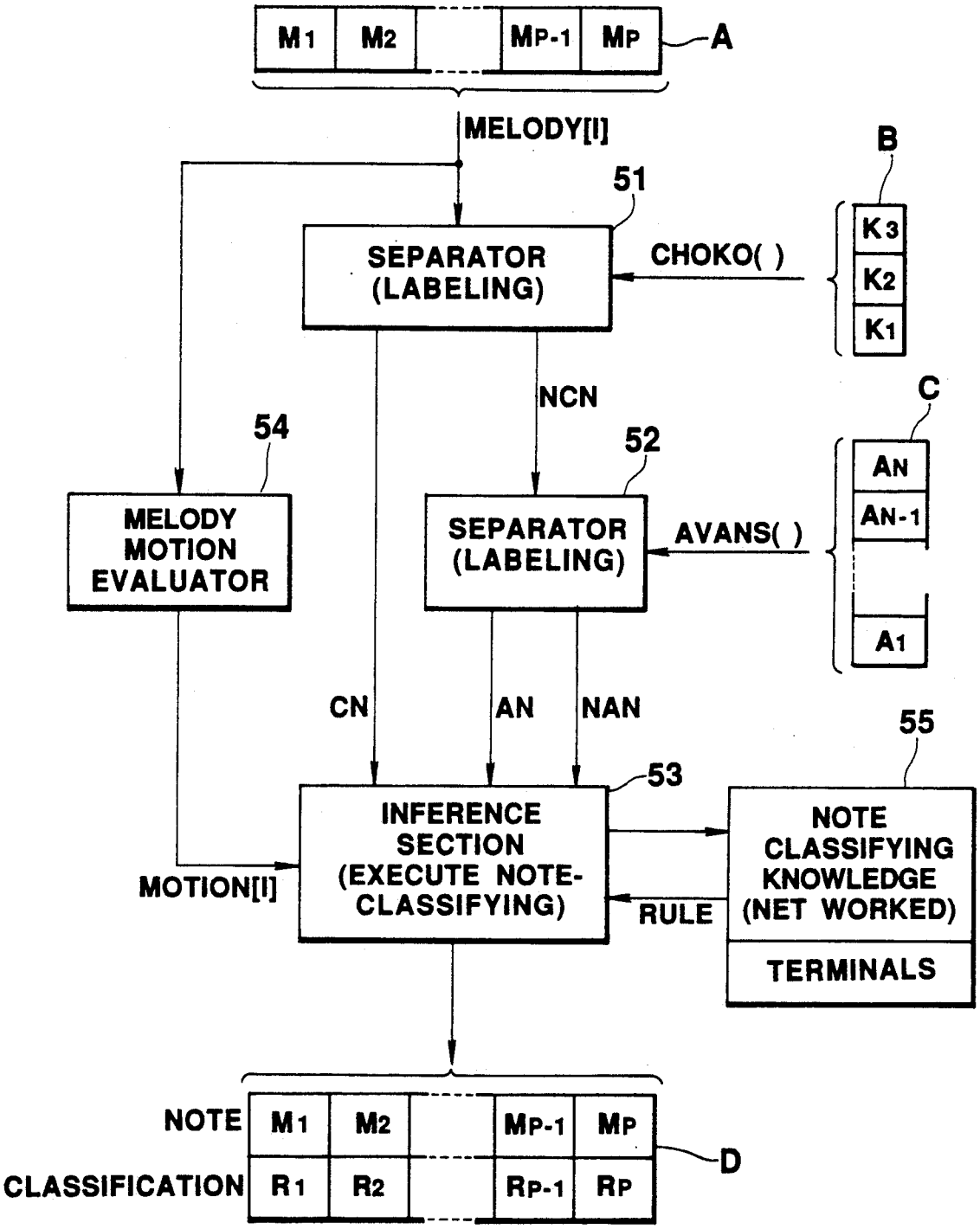
FIG. 3 is a block diagram of an embodiment of the evaluator in FIG. 2.

FIG. 3 shows an embodiment of the evaluator 50 in a block diagram. In FIG. 3, A array indicates a melody of notes $M_1$ to $M_P$. The output of A array is denoted by MELODY[I]. B array indicates a pitch class set of chord notes CHOKO ( ) for A melody. B array is shown in FIG. 3 to have three chord note members. Actually, the number of chord notes depends on chord types. C array stores a pitch class set of available notes, individually designated by $A_1$ to $A_N$ and collectively denoted by AVANS( ).

A first (labeling) separator 51 separates each melody note MELODY[I] into two groups, i.e., a chord note CN (chord-note labeled melody note) and a non-chord note NCN (non-chord note labeled melody note) in accordance with the set of chord member notes CHOKO( ) from B array. If a melody note is identical in pitch class with one of the chord member notes, that melody note is labeled with a chord note CN. A melody note is a non-chord tone NCN if it has a pitch class outside of the chord members.

A second (labeling) separator 52 receives non-chord labeled melody notes NCN from the first separator 51 and separates each NCN into two groups i.e., an available note AN (available-labeled melody note) and an unavailable note NAN (unavailable-labeled melody note) in accordance with the pitch class set of available notes AVANS( ) from C array. If a melody note has the same pitch class as one of the available notes, that melody note is an available note AN. A melody note is an unavailable note NAN if the pitch class thereof is outside the pitch class contents of the available notes AVANS( ).

Each melody note MELODY[I] from A array has now been classified into three different categories of chord-note labeled melody note CN, available labeled melody note AN and unavailable labeled melody note NAN. These classified melody notes CN, AN and NAN are supplied to an inference section 53 for further identification of the respective melody notes. To this end, the inference section 53 needs additional information about motions in the melody and about knowledge of note-classification.

A melody motion evaluator 54 receives melody notes MELODY[I] from A array and evaluates motions therein. Knowledge of note-classification is stored in a note classifying knowledge section 55. The melody motion evaluator 54 may take several forms depending on knowledge representation in the section 55. In an embodiment, the motion evaluator 54 comprises a pitch interval generator which generates a pitch interval from one melody note to another. I-th pitch interval PI(I) formed between I-th melody note MELODY (I) and (I+1)-th melody note MELODY(I+1) may be given by PI(I)=NOTE(MELODY (I+1)−NOTE (MELODY(I)) In another embodiment, a pitch interval between adjacent melody notes is evaluated in terms of pitch motion having two classifications of stepwise (conjunct) motion and leap (disjunct) motion. There is no pitch motion in two melody notes having the same pitch. The stepwise motion may be defined by a pitch interval of either semitone (minor second degree) or whole tone (major second degree) whereas the leap motion may be defined by a pitch interval greater than a whole tone. With respect to polarity the stepwise motion may be subdivided into step-up motion and step-down motion.

In a further embodiment, the melody motion evaluator 54 evaluates a pitch motion or movement in three or more successive melody notes as well as those in two successive melody notes. For example, the melody motion evaluator 54 may evaluate a passing movement ↗, ↘) for a melody portion where two or more stepwise motions in the same polarity continues, and determine a neighboring movement (⋀, ⋁) for a melody portion where a stepwise motion in one polarity is connected to another stepwise motion in the opposite polarity. In addition, the motion evaluator 54 may compute rhythm motions in the melody such as durational proportions of the melody notes. In FIG. 3, the output of the melody motion evaluator is collectively denoted by MOTION[I].

The note classifying knowledge section 55 stores musical knowledge of classifying musical notes in terms of their functions or characters. The note classifying knowledge may be represented by a set of musical rules having a net or tree structure extending from a root to a plurality of leaves or terminals. Each terminal indicates a specific character of a musical note. Each rule comprises an if-part (condition part) and two consequent parts including a then-part to be applied if the condition part is true and an else-part to be referenced if the condition part is false. Each consequent part points to another rule to be explored next if such rule remains or indicates a terminal if no further rule remains unexplored.

In order to identify each melody note from A array, the inference section 53 explores through the network of the note-classifying knowledge for each melody note until a terminal indicative of a note character has been found: Having had access to a musical rule, the inference section 53 sets situational variables contained in the condition-part of that rule by using the labels (CN, AN, NAN) from the separators 51 and 52 of those melody notes which include a melody note under analysis and its surrounding melody notes, and motions from the melody motion evaluator 52 associated with the melody note under analysis and its surrounding notes to test the condition part. According to the test result, the inference section 53 selects one of the consequent parts and gains access to the next rule pointed to by the selected consequent part to continue forward reasoning. Eventually, the inference section will reach a terminal consequent part that indicates identification (classification) of a melody note under analysis.

In the arrangement of FIG. 3, the inference section 53 does not need to further classify those melody notes labeled with a chord note CN. The inference section 53 does subclassify available-labeled melody notes AN and unavailable-labeled melody notes NAN. For each available labeled melody note, the inference section 53 starts its forward reasoning at a root rule for an available note in the network of note-classifying knowledge 55, while for each unavailanble labeled melody note, foward reasoning starts with a root rule for an unavailable note.

D array in FIG. 3 indicates the output from the inference section, in which classified results of melody notes $M_1, M_2, \ldots M_{P-1}$ and $M_P$ are denoted by $R_1, R_2, \ldots R_{P-1}$ and $R_P$, respectively.

The classifed results may be outputted and/or displayed in a suitable format by means of the monitor 4 in FIG. 1.

The evaluator 50 in FIG. 3, which is arranged by a plurality of modules as shown, makes it readily feasible to realize a number of different evaluators by providing a plurality of different and selectable melody motion evaluators and/or a plurality of different and selectable note classifying knowledge sections.

Details

Components of the melody analyzer will be described in more detail hereinafter.

FIG. 5 exemplifies numerical data representation of several musical elements. Each of NOTE( ), ROOT and KEY( ) represents a pitch class. There are twelve pitch classes in total from C to B. Pitch class C is represented by a number of "0", C# by "1" and so on until B by "11" by assigning "1" to a pitch interval of a semitone. The illustrated chord type TYPE( ) set comprises five elements, specifically major, minor, seventh, major seventh and minor seventh in which major (MAJ) is represented by a number "0", minor (MIN) by "1", seventh(7TH) by "2", major seventh (MAJ7) by "3", minor seventh (MIN7) by "4". The chord type set may be expandable. The illustrated scale type scale( ) set comprises three elements; natural scale (NATURAL), melodic minor scale (MRLODIC MIN) and harmonic scale (HARMONIC MIN) in which natural scale is numbered by "0", melodic minor scale by "1" and harmonic minor scale by "2". The scale type set may be extendible.

FIG. 6 illustrates a chord note table which stores, with respect to each chord type of MAJ, MIN, 7th, MAJ7 and MIN7, a set of chord member notes in terms of pitch class assuming a reference chord root of C pitch class (which may also be regarded as a set of chord notes in terms of relative pitch (pitch interval) from a chord root independent of pitch class).

FIG. 7 exemplifies a tension note table which provides with respect to each chord type a set of tension notes in terms of pitch class assuming a reference chord root of C (or in terms of pitch interval (degree) from a pitch class independent chord root). For example, D pitch class corresponds to 9th degree, F to 11th and A to 13th.

Figures 8, 10:
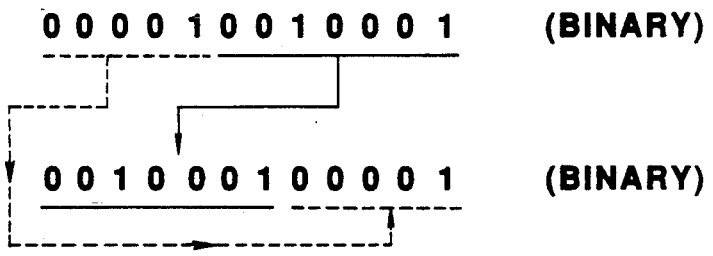
FIG. 8 illustrates a scale note table.
FIG. 10 shows pitch-shifting of a set of note pitches.

FIG. 8 illustrates a scale note table which provides, with respect to each scale type of natural scale, melodic minor and harmonic minor, a set of scale notes in terms of pitch class. For natural scale, the shown scale note data assumes a key note of C in case of natural major scale and a key note of A in case of natural minor scale. For melodic and harmonic minor scales, a key note of A is assumed.

FIG. 9 shows a memory map of ROM2 (FIG. 1) in which the above-mentioned chord note table, tension note table and scale note table are implemented. A relative address "00" (hexadecimal) of ROM2 stores a base address of the chord note table denoted by {CHOKO( )}. The address "01" stores a base address of the tension note table {TENSN( )}. The address "02" stores a base address of the scale note table {SCAKO( )}. Each data in ROM2 is shown here in FIG. 9 in hexadecimal notation. For example, chord note data for a chord type of minor seventh is shown by 489 (hexadecimal). In binary, this is expressed by:

0 1 0 0 1 0 0 0 1 0 0 1 (binary)

↓ ↓ ↓ ↓

B♭ G E♭ C

As noted, each data (of chord note set, tension note set and scale note set) comprises twelve bits in which the least significant bit (LSB) position is assigned to a pitch class of C, the next bit position to C# and so on until the most significant bit (MSB) position is assigned to a pitch class of B. A bit having a value of 1 indicates presence of a note with a pitch class assigned to that bit position. Accordingly to store the required data ROM2 may comprise a memory of either 12 bits/word or 16 bits/word in which case the highest four bits are not used to store the required data.

As stated before, each melody note information MELODY[I] comprises a pitch class, an octave number and a duration. Such information may be represented by a 16 bit integer in which the lowest 4 bits are assigned to a pitch class, the next lowest 4 bits to an octave number and the highest 8 bits to a duration. From the 16 bit data of a melody note MELODY[I], any component thereof can be taken out. For example, the pitch class data NOTE (MELODY[I] of the melody note is obtained by masking the highest 12 bits of MELODY[I].

Also CHORD[I] and TONALITY[I] have a suitable data format to represent a chord defining a root/type and a tonality defining a key note/mode respectively.

The chord note generator 10 generates from a given chord CHORD[I] a set of chord notes CHOKO( ) thereof as follows:

CHOKO(CHORD[I]) =
ROT(*(*(00) + TYPE(CHORD[I])),
ROOT(CHORD[I]).

More specifically, CPU1 calculates an address in ROM2 where a set of chord notes for the type of the given chord are stored and reads the data stored therein. This address is given by a formula (*(0 0)+TYPE(CHORD[I]) in which *(0 0) indicates data stored at address "0 0" i.e., the value of the base address of the chord note table {CHOKO( )}, and TYPE(-CHORD[I]) indicates the type of the given chord. The read data indicates chord note pitch classes that assume a predetermined chord root of C pitch class. It is therefore necessary to shift the read chord note pitch classes in accordance with the root pitch class of the given chord which may be different from C.

ROT(A, 1) indicates an operation of moving up chord note pitch classes in data A by a step of a semitone. When MSB bit of the data A is "1" ROT(A, 1) is given by ROT(A, 1)=(result from shifting each bit in A to the left by one bit position)+1. When MSB bit of the data A is "0", ROT(A, 1)=(result from shifting each bit in A to the left by one bit position).

ROT(A, B) indicates repeating ROT(A, 1) operations as many as B times. For chord, B has the numeric value of the root pitch class of the given chord ROOT(-CHORD[1]).

FIG. 10 illustrates a pitch shift operation in which chord note data of C major read from chord note table CHOKO( ) is pitch-shifted to F major chord note data.

In a similar manner, the tension note generator 20 generates from a given chord CHORD[I] a set of chord note pitch classes TESN(CHORD[I]) as follows:

TENS(CHORD[I]) =
ROT(*(*(01) + TYPE(CHORD[I])),
ROOT(CHORD[I]))

Also, scale generator 30 generates from a given tonality TONALITY[I] a set of scale note pitch classes DIATS(TONALITY[I]) by:

DIATS(TONALITY[I]) =
ROT(*(*02) + SCALE(TONALITY[I])),
KEY(TONALITY[I]))

The available note generator generates from tension note pitch class set data TESN(CHORD[I])) and coexisting scale note pitch class set data DIATS(-TONALITY[I])), a set of available note pitch classes by logically ANDing TESN(CHORD[I]) and DIATS(-TONALITY[J]) with respect to each bit as:

AVANS(CHORD[I],
TONALITY[J])=TENSN(CHORD[I])-
ΛDIATS(TONALITY[J])

Figure 11A:
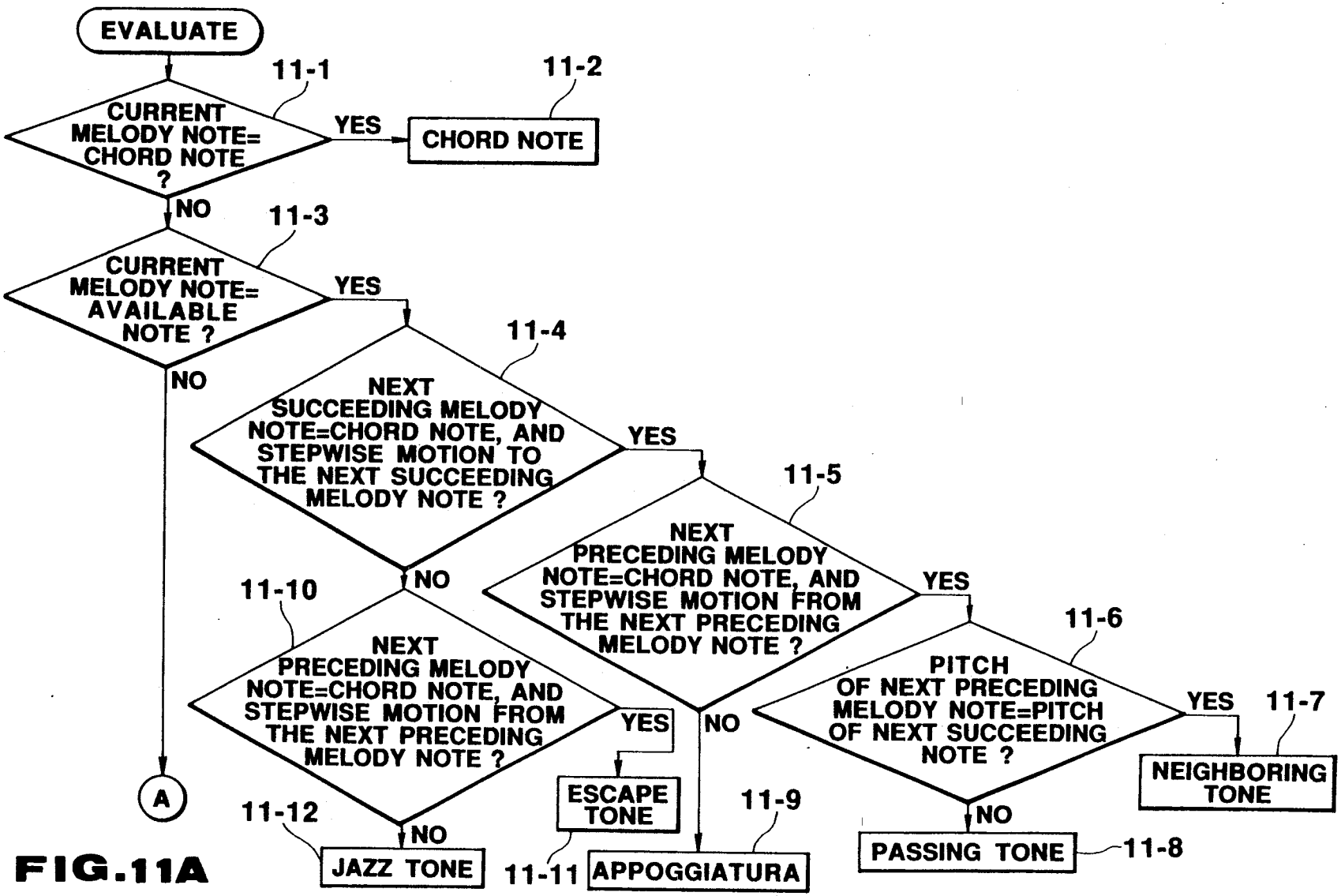
FIGS. 11A and 11B show a flow chart of the operation of the evaluator in FIG. 2.
Figure 11B:
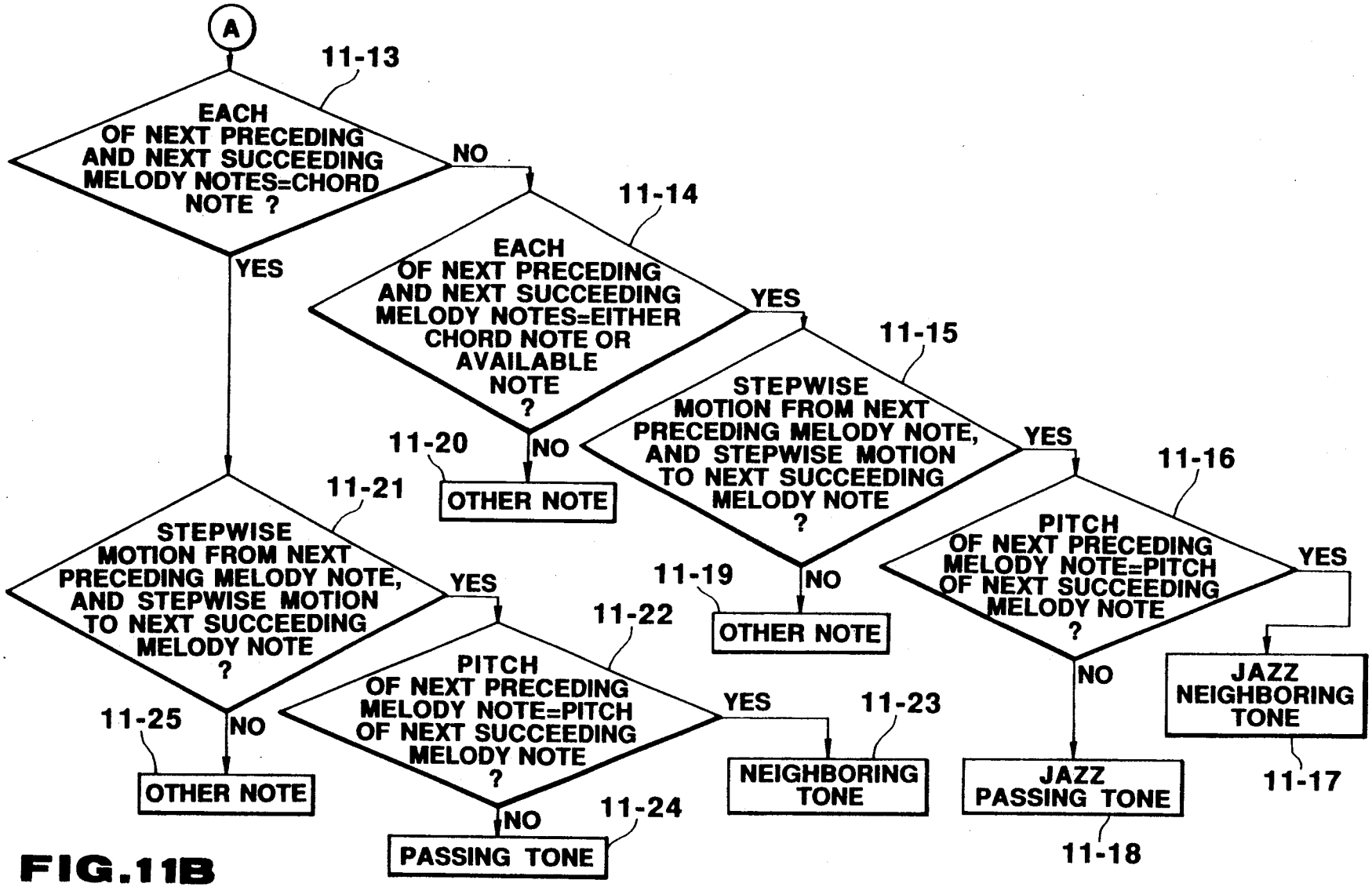

FIG. 11 illustrates an operation of the evaluator 50 in a network of musical rules representative of note-classifying knowledge. Each of rectangular boxes 11-2, 11-7, 11-8, 11-11, 11-12, 11-17, 11-18, 11-19, 11-20, 11-23, 11-24 and 11-25 indicates a classified conclusion of a melody note. A decision is made at each lozenge box 11-1, 11-3, 11-4 to 11-6, 11-13, 11-16, 11-21 and 11-22. The illustrated network of note classifying knowledge may partiably or entirely be stored in a memory such as ROM2 in FIG. 1, either as production rule data or as a note classifying program. In an embodiment in which the whole network of note classifying knowledge is formed by data of production rules, the box 11-1 will correspond to a root rule to be first referenced during the execution of the inference program.

Each rule has a condition part which may be represented in the following form:

$$Li \leqq F(Xi) \leqq Ui$$

For a root rule with i=1, F(Xi)i.e., F(X1) is a variable which indicates either a chord note (F(X1)=1), an available note (F(X1)=2), or an unavailable note (F(X1)=3). Lower limit data L1 has a value of "1" indicative of a chord note while the upper limit U1 also has a value of "1". In operation, CPU1 (inference section 53) sets the variable F(X1) to a label value attached to a melody note under analysis by the separators 51 and 52 to test the condition part $L1(=1) \leqq F(X1) \leqq U1(=1)$. If the melody note under analysis is a chord note (chord-note labeled melody note), this condition part of the root rule is met, otherwise dissatified.

Each rule further comprises two consequent parts i.e., then-part Yi and else-part Ni. If the condition part is true, the then-part is selected whereas if the condition part is false, the else-part Ni is selected. In this manner, each rule data in the production memory comprises five items of Xi indicative of a type of a situational function, upper limit Ui, lower limit Li, then-part Yi and else-part Ni. Each consequent part Yi and Ni either points to a rule to be applied next or indicates a terminal having a value of melody note classification (identification). For example, data N1 which is selected when the condition part of the root rule is met has a value identifying a chord note (e.g., N1=−1), while data Y1 selected when the condition part is false has a value pointing to the next rule (e.g., Y1=2). In the former case, since the data N1 denotes a terminal of the note classifying knowledge network, the absolute value of N1 is set to a suitable conclusion register R1(R1=|N1|=1) to terminate the note-classifying (inference) operation on the melody note under analysis. In the latter case, a condition part of a second rule pointed to by Y1(=2) is tested, which test corresponds to the box 11-3 in FIG. 11. The note classifying operation continues to explore through the network of the note classifying knowledge until a terminal has been reached. Using the data format of a rule discussed above, some of the lozenge boxes in FIG. 11 are represented by a subnetwork of a plurality of such rules as is obvious to one skilled in the art.

In boxes 11-4, 11-5, 11-15, 11-21 etc., a test is made for stepwise motion(s) in association with a melody note and its adjacent note(s). Information about a stepwise motion is taken out from melody notes as follows. A pitch interval PI(p) of a melody note MELODY[P] from the next preceding melody note MELODY[P-1] is given by subtracting the absolute pitch of MELODY[P-1] from that of MELODY[P] as:

$$PI(P) = \{12 \times OCTB(MELODY[P]) + NOTE(MELODY[P])\} - \{12 + OCTB(MELODY[P - I])\} + NOTE(MELODY[P - I]\}$$

A stepwise motion is defined by PI(P)="1", "2", "−1" or "−2", indicative of (major or minor) second degree.

Main Flow

Figure 12:
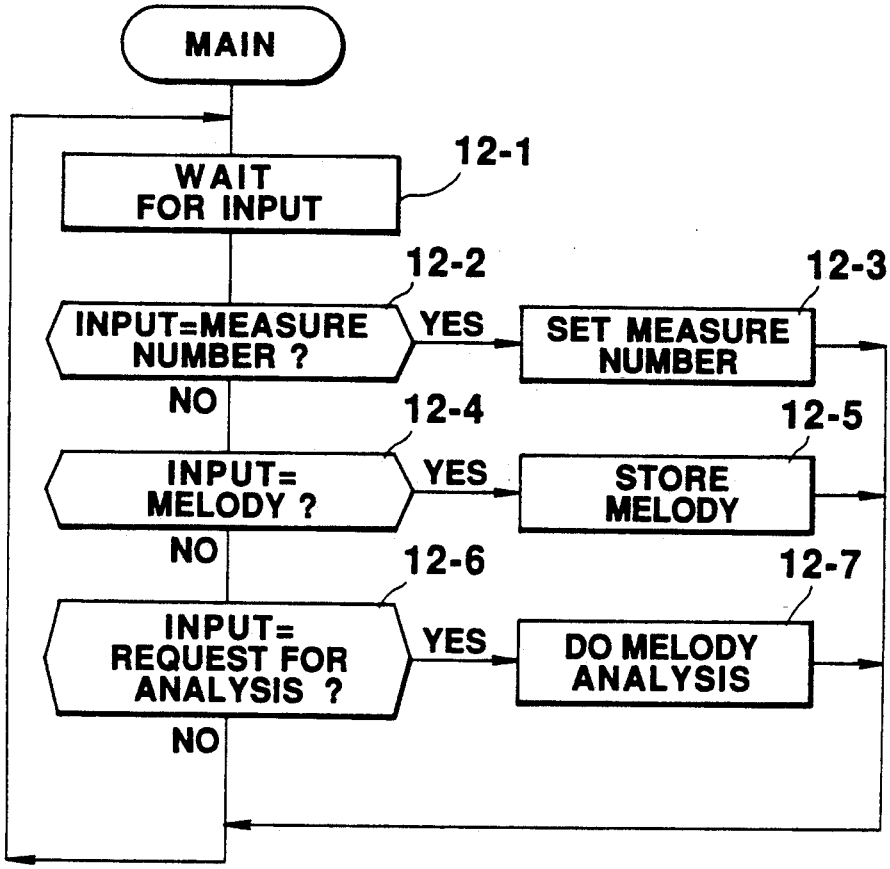
FIG. 12 is a flow chart for analyzing a melody per measure.

FIG. 12 illustrates a main flow chart of an operation of the melody analyzer. According to the flow, melody analysis is performed per measure. In the routine 12-1 CPU1 waits for an input from the input unit 3. In response to an input for designating a measure number, CPU1 sets a measure register (not shown) to the designated measure number (12-2 and 12-3). In response to a request for melody data entry, CPU1 prompts the user to input melody data and stores the entered melody data in the melody note array {MELODY( )} in RAM5 (12-4 and 12-5). For a request for melody analysis CPU1 carries out a melody analysis operation on a portion of the melody with respect to the previously designated measure and outputs the analyzed result (12-6 and 12-7).

From the designated measure number BAR NO, CPU1 locates in the melody note array {MELODY []} which melody note is the first melody note in the designated measure number. This is done as follows.

$$(BAR\ NO\text{-}1) \times BEAT \quad (1)$$

$$\Sigma(LENM(MELODY[I]) \quad (2)$$

wherein BEAT indicates a length of one measure in terms of a multiple of unit (e.g., shortest note) lengths, and LEM (MELODY [I]) indicates a duration of a melody note in terms of a multiple of the unit lengths. Duration of other musical elements, such as chord and tonality is similarly represented.

CPU1 accumulates durations of successive melody notes with respect to I in the formula(2), starting from the first melody note (I=1) in the melody array {MELODY[]} until the accumulated value first exceeds the value of formula(1). Then, the value of I points to a melody array element that stores data of the first melody note in the designated measure number BAR NO. If in the formula(1) BAR NO is taken placed by (BAR NO+1) and a similar operation is performed, then the resultant value of I points to an melody array element that stores data of the first melody note in a measure next succeeding the designated measure. If this value of I is the same as the previously obtained value of I pointing to the first melody note in the designated measure, this indicates that the designated measure contains a single melody note, which extends over the bar-line. If the value of I obtained with (BAR NO+1) is unequal to the value of I obtained with BAR NO, then (the former value−1) will point to a melody array element where the last melody note in the designated measure BAR NO is stored. In this manner CPU1 locates a portion of the melody to be analyzed.

In order to locate a chord coexistent with a melody note, CPU1 determines an element number in the chord array {CHORD[]} that corresponds in time to a melody note MELODY[P]. This is done as follows.

$$\Sigma(LENM(MELODY[J])\} \quad (3)$$

$$\Sigma(LENC(CHORD[I])\} \quad (4)$$

CPU1 accumulates the formula(3) to obtain an accumulated duration of melody notes from J=1 to J=P. Then CPU1 accumulates the formula(4) with respect to I until the accumulated value first exceeds the value of the formula(3), at which time the value of I points to a chord CHORD[I] in the chord array {CHORD[]} that coincides with the melody note MELODY[P].

Also CPU locates a tonality in the tonality array {TONALITY[]} corresponding to the melody note MELODY[P] in a similar manner.

It is convenient that the process of locating coexisting musical elements is executed in a consecutive manner to reduce redundancy. For example CPU1 places the first melody note data MELODY[S] in the designated measure onto the first element of a coexisting array (not shown). Data of a corresponding chord CHORD[I] (in the chord array) and a corresponding tonality TONALITY[U] (in the tonalities array) which coexist with the first melody note MELODY[S] are placed onto the second and third elements of the coexisting array, respectively. In this manner a first coexisting set of musical elements MELODY[S], CHORD [I] and TONALITY[U] are formed on the coexisting array as its first three elements. In the next array element, a second melody note data MELODY[S+1] in the designated measure (if any) is placed. A similar process continues until the last coexisting set with respect to the last melody note in the designated measure has been formed on the coexisting array. Having completed the coexisting array, CPU1 can analyze the designated measure melody by classifying one melody note after another in the manner stated before while referencing the coexisting array.

The flow chart of FIG. 12 may be modified such that melody analysis is performed with respect to a designated phrase instead of a measure. In the flow of FIG. 12, {CHORD[]} data of a succession of chords and {TONALITY[]} data of a succession of tonalities remain unchanged. Change and entry of these data {CHORD[]} and {TONALITY[]} are carried out in a separate process (not shown).

From the analyzed results of melody note classifications (which are displayed in 12-3 in FIG. 12), a user may judge the melody. If the melody is not found to be satisfactory, a modified melody will be composed either by the user or by an automatic composer, and will be analyzed again by the melody analyzer. Therefore, the present melody analyzer also serves as a supporting tool for aiding melody composition and may be incorporated into an automatic composer.

The above concludes the detailed description of the illustrated embodiment. However, various modifications and alterations will be obvious to one skilled in the art.

Figure 13:
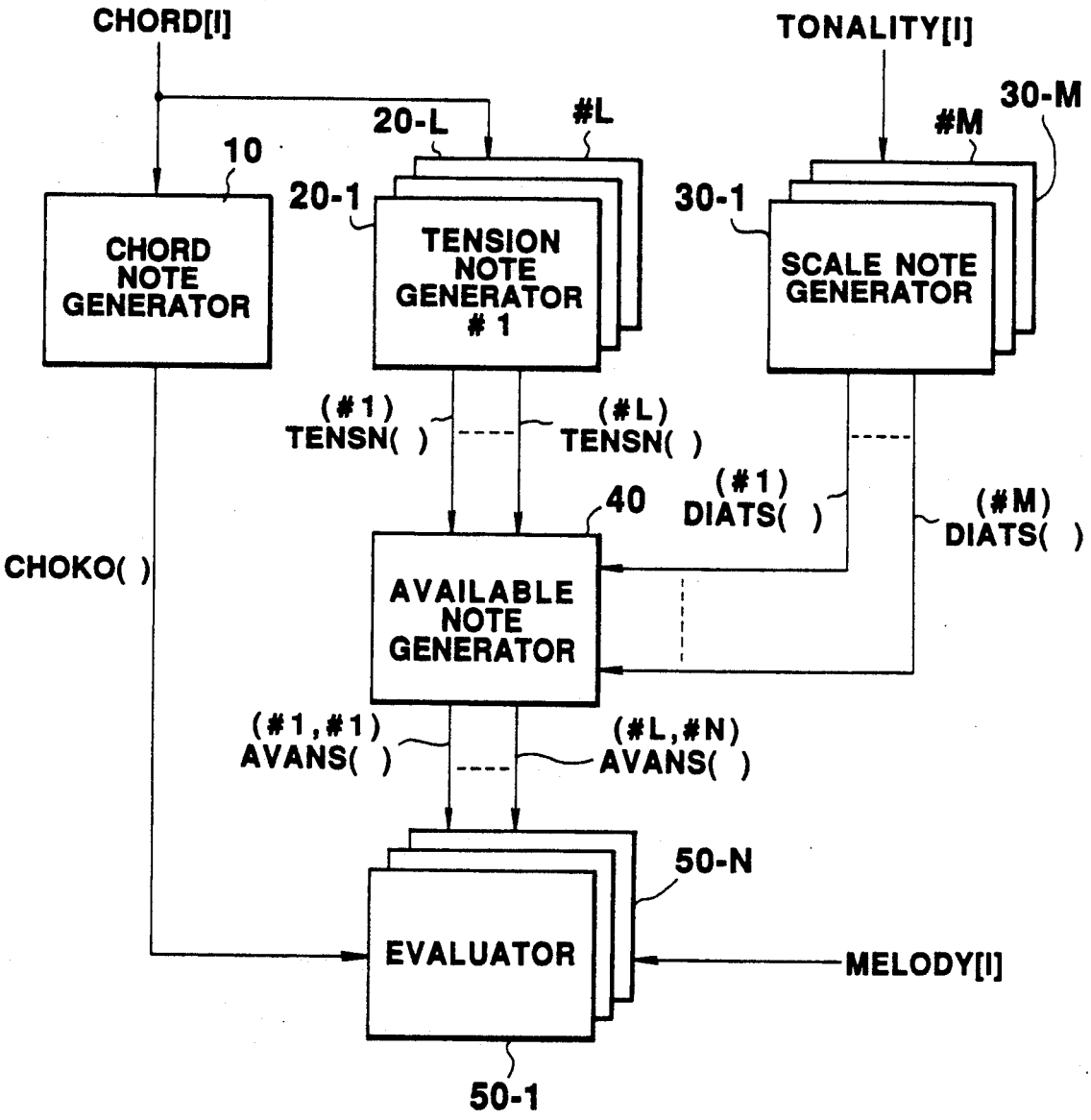
FIG. 13 is a block diagram showing functions of a modified melody analyzer.

For example, there may be provided a plurality of different modules such as a plurality of different tension note tables (or generators), a plurality of different scale note tables (or generators) and/or evaluators within the melody analyzer so that it can analyze a melody with respect to each of the plurality of the modules. Such a modification is illustrated in FIG. 13 in which the melody analyzer comprises a plurality of tension note scale generators designated by 20-1 to 20-L, a plurality of scale note generators designated by 30-1 to 30-M and a plurality of evaluators 50-1 to 50-N. For example, the first tension note generator 20-1 includes a table that stores data corresponding to a subset of the tension notes in FIG. 7 with respect to each chord type while the second tension note generator 20-2 includes a table that contains another subset of the tension notes in FIG. 7 and so on. Similarly, the first evaluator 50-1 may have the same network as that of note classifying knowledge shown in FIG. 2 while the second evaluator 50-2 has another network of note classifying knowledge and so on. This arrangement may establish one to at least one correspondence between chord types and tension note sets. For example, it may be arranged such that a chord type is always assigned to a single set of tension notes whereas another chord type is assignable to any one of a plurality of different tension note sets. A similar relationship may be formed between scale types and scale note sets. For example, a scale type of a major is assigned to one scale note set of "do, re, mi, fa, sol, la, ti" forming the major scale while a scale type of a minor is assignable to any of three different scale note sets i.e., the natural minor scale note set of "la, ti, do, re, mi, fa, sol", the harmonic (or descending melodic) minor scale note set of "la, ti, do, re, mi, fa, sol#" and the ascending melodic minor scale note set of "la, ti, do, re, mi, fa#, sol#." It may also be arranged such that the correspondence relation between TONALITY[I] and SCAKO( ) depends on a degree of fineness of scale type or mode information contained in TONALITY[I] so that if such mode information indicates for example a subjective parameter such as brightness/darkness, a plurality of scale note sets may be assigned to each mode. In addition to modes of major and minor, other modes may be provided as TONALITY[I] such as dorian from which a scale note set of "re, mi, fa, sol, la, ti, do" is produced by the scale note generator and a pentatonic from which a scale note set of "do, re, mi, sol, la" is produced.

In the FIG. 13 arrangement, outputs from the plurality of generators are distinguishably treated with each other. For example, the first tension note scale generator 20-1 generates data (#1) TENSN( ) which is received by the available note generator 40 as tension note set data from the first tension note scale generator 20-1, not from the other tension note scale generators 20-2 to 20-L. Similarly, an available note set output (#1, #1) AVANS( ) from the available note generator 40 is received by the respective evaluators 50-1 to 50-N as available note set data that has been produced from the first tension note generator 20-1 output and the first scale note generator 30-1 output. An analyzed result from the first evaluator 50-1 using the data (#1, #1) AVANS( ) is sent to the monitor 4 as the analyzed result produced by a particular combination of the first tension note generator 20-1, the first scale note generator 30-1 and the first evaluator 50-1. The monitor 4 displays the data as such to a user. In this manner, the arrangement of FIG. 3 provides a good number of analyses of a given melody from which the user may make best judgement on the melody.

In the alternative, it can be arranged such that the user may select a combination from the plurality of the generators and the evaluators to cause the selected combination to perform melody analysis.

In FIG. 2, an available note set AVANS( ) is indirectly synthesized from a chord CHORD[I] and a tonality TONALITY[I] by a preferred arrangement of the chord note generator 10, tension note generator 20, scale note generator 30 and available note generator 40. If desired, such an available note set AVANS( ) may be more directly produced from CHORD[I] and TONALITY [I] by the provision of a direct transformation table that stores an available note set with respect to each combination of a chord type, a chord root, a tonality scale type and a tonality key note, and read-access means that reads a set of available note set from the transformation table corresponding to given data of chord and tonality. Such transformation table requires, however, a relatively large number of storage locations and it is relatively difficult to correct or edit the contents thereof.

Further, if desired, it may be arranged such that a sequence of available note sets in place of a sequence of tonalities {TONALITY[]} is inputted to the melody analyzer to eliminate the means for synthesizing a set of available notes.

Whereas the illustrated embodiment of the melody analyzer is designed to provide a microscopic melody analysis by classifying and identifying musical functions of individual melody notes, there may be added means for providing a relatively macroscopic melody analysis concerning a global or structural feature of the melody. For example, global evaluator means may be provided which produces from a sequence of analyzed results of individual melody notes a frequency table (histogram) thereof and/or frequency variations from one measure (or phrase) to another. Further, there may be added a musical style analyzer which automatically determines from such frequency table a musical style of the analyzed melody.

The present invention can also be applied to an automatic melody composer. A melody from an automatic composer is passed to the melody analyzer of the invention to obtain analyzed results {Ri} thereof. The automatic composer judges the melody (of one measure for example) by matching the analyzed results against criteria that indicate a set and/or histogram of melody note characters to be contained in a desired melody and may have been determined by a musical style selected by an input from a user. In case of mismatch, the automatic composer automatically changes control parameters such as pitch transitions between melody notes and re-composes a melody in accordance with the changed control parameters. The re-composed melody is re-analyzed and re-judged in a similar manner. The automatic process repeats until the criteria are met with respect to a re-composed melody. In this manner, the melody analyzer of the invention serves as part of the automatic composer.

Therefore, the scope of the invention should be limited only by the appended claims.

What is claimed is:

1. A melody analyzer for analyzing a given melody from a given chord and a given tonality, comprising:
   available note generator means for generating a set of available note pitches from said chord and said tonality;
   melody motion evaluator means for evaluating motions in said melody; and
   melody note classifying means for classifying each note in said melody based on at least said set of available note pitches and said evaluated motions in said melody, the melody analyzer analyzing a melody in which a note in said set of available note pitches is freely used based on classification of notes by said classifying means.

2. The melody analyzer as claimed in claim 1 wherein:
   said melody motion evaluator means comprises means for evaluating, as said melody motions, pitch intervals each formed between adjacent notes in said melody; and
   said melody note classifying means comprises means for classifying each note in said melody based on at least said set of available note pitches and said evaluated pitch intervals.

3. A melody analyzer for analyzing a given melody from a given chord and a given tonality, comprising:
   available note generator means for generating a set of available note pitches from said chord and said tonality;
   first determining means for determining, with respect to each note in said melody, based on said set of available note pitches, whether the note is an available note or an unavailable note; and
   second determining means for determining, with respect to each note that has been determined to be an unavailable note by said first determining means, a character of the note by evaluating motions associated with the note, the melody analyzer analyzing a melody in which a note in said set of available note pitches is freely used based on a character of the note.

4. A melody analyzer for analyzing a given melody from a given chord and a given tonality, comprising:
   chord note generator means for generating from said chord a set of chord note pitches forming said chord;
   available note generator means for generating a set of available note pitches exclusive of said set of chord note pitches;
   melody motion evaluator means for evaluating motions in said melody; and
   melody note classifying means for classifying each note in said melody based on at least said set of chord note pitches, said set of available note pitches and said evaluated motions in said melody, the melody analyzer analyzing a melody in which a note in said set of available note pitches is freely used and based on classification of notes by said melody note classifying means.

5. The melody analyzer as claimed in claim 4 wherein said tonality is represented by data indicative of a key note of a scale and a type of said scale, wherein said chord is represented by data indicative of a root of a chord and a type of said chord and wherein said melody is represented by data indicative of a succession of melody notes.

6. The melody analyzer as claimed in claim 4 wherein said available note generator means comprises:
   (A) tension note generator means for generating from said chord a set of tension note pitches for said chord;
   (B) scale note generator means for generating from said tonality a set of scale note pitches for said tonality; and
   (C) common note generating means for generating as said set of available note pitches a set of note pitches that are common to said set of tension note pitches and said set of scale note pitches.

7. The melody analyzer as claimed in claim 6 wherein said tension note generator means comprises:
   tension note table storage means for storing with respect to each type of chords having a predetermined root a set of tension note pitches;
   reading means for reading from said tension note table storage means a set of tension note pitches with respect to a type of said chord; and
   means for shifting each pitch of said set of tension note pitches from said reading means in accordance with a pitch difference between a root of said chord and said predetermined root to provide a set of tension note pitches for said chord.

8. The melody analyzer as claimed in claim 6 wherein said scale note generator means comprises:
   scale note table storage means for storing with respect to each type of scales having a predetermined key note a set of scale note pitches;
   reading means for reading from said scale note table storage means a set of scale note pitches with respect to a scale type of said tonality; and
   means for shifting each pitch of said set of scale note pitches from said reading means in accordance with a pitch difference between a key note of said tonality and said predetermined key note to provide a set of scale note pitches for said tonality.

9. A melody analyzer comprising:
   chord providing means for providing chord data indicative of a root and type of a chord;
   scale providing means for providing scale data indicative of a key note and type of a scale;
   melody providing means for providing melody data indicative of a pitch and duration of each note in a melody;
   chord note generator means for generating, from said chord data, pitch contents of chord notes forming said chord;
   selecting means for selecting a tension; tension note generator means responsive to said selecting means for variably generating, from said chord data, pitch contents of tension notes for said chord;
   scale note generator means for generating, from said scale data, pitch contents of scale notes forming said scale;
   available note generator means for generating pitch contents of available notes by selecting pitch contents common to said pitch contents of said tension notes from said tension note generator means and said pitch contents of said scale notes from said scale note generator means;

first classifying means for classifying into a chordal melody note those notes in said melody that have a pitch included in said pitch contents of said chord notes;

second classifying means for classifying into an available melody note those notes in said melody that have a pitch included in said pitch contents of said available notes;

third classifying means for classifying into an unavailable melody note those notes in said melody that have a pitch not included in either of said pitch contents of said chord notes and said pitch contents of said available notes;

motion evaluator means for evaluating motions associated with each note in said melody;

first subclassifying means for subclassifying each note classified as said available melody note based on classification results from said first, second and third classifying means of melody notes around said each note classified as said available melody note and based on motions from said motion evaluator means associated with said each note classified as said available melody note and said melody notes around said each note classified as said available melody note; and second subclassifying means for subclassifying each note classified as said unavailable melody note based on classification results from said first, second and third classifying means of melody notes around said each note classified as said unavailable melody note and based on motions from said motion evaluator means associated with said each note classified as said unavailable melody note and said melody notes around said each note classified as said unavailable melody note, the melody analyzer thereby analyzing a melody in which a note in said pitch contents of said available notes is freely used.

10. A melody analyzer for analyzing a given melody from a given chord and a given tonality, comprising:

chord note generator means for generating from said chord a set of chord note pitches forming said chord;

available note generator means for generating a set of available note pitches exclusive of said set of chord note pitches;

melody motion evaluator means for evaluating motions in said melody;

melody note classifying means for classifying each note in said melody based on at least said set of chord note pitches, said set of available note pitches and said evaluated motions in said melody; and output means for outputting classification results from said melody note classifying means, the melody analyzer thereby analyzing a melody in which a note in said set of available note pitches is freely used and based on classification of notes by said melody note classifying means.

11. A melody analyzer comprising:

chord succession providing means for providing a succession of chords each for a different one of a plurality of music time intervals;

scale succession providing means for providing a succession of scales each for a different one of said plurality of music time intervals;

melody succession providing means for providing a succession of melodies each for a different one of said plurality of music time intervals;

chord note generator means for generating, from a chord in said succession of chords with respect to one of said plurality of music time intervals, a set of chord notes forming said chord;

available note generator means for generating, from said chord and a scale in said succession of scales with respect to said one of said plurality of music time intervals, a set of available notes exclusive of said set of chord notes;

melody motion evaluator means for evaluating motions in a melody in said succession of melodies with respect to said one of said plurality of music time intervals; and melody note classifying means for classifying said melody based on at least said set of chord note, said set of available notes and said evaluated motions in said melody, the melody analyzer thereby analyzing a melody in which a note in said set of available notes is freely used.

12. A melody analyzer comprising:

means for providing a set of chord note pitches;

means for providing a set of available note pitches;

means for providing a melody;

melody motion evaluator means for evaluating motions in said melody; and melody note classifying means for classifying each note in said melody based on at least said set of chord note pitches, said set of available note pitches and said evaluated motions in said melody, the melody analyzer thereby analyzing a melody in which a note in said set of available note pitches is freely used and based on classification of each note by said melody note classifying means.

13. A melody analyzer comprising:

means for providing a set of available note pitches;

means for providing a melody;

melody motion evaluator means for evaluating motions in said melody; and melody note classifying means for classifying each note in said melody based on at least said set of available note pitches and said evaluated motions in said melody, the melody analyzer thereby analyzing a melody in which a note in said set of available note pitches is freely used and based on classification of each note by said melody note classifying means.

* * * * *